US011714377B2

(12) United States Patent
Fujiwara

(10) Patent No.: US 11,714,377 B2
(45) Date of Patent: Aug. 1, 2023

(54) IMAGE FORMING APPARATUS WITH COVER AND RESTRICTOR TO PROTECT CONNECTION TERMINAL

(71) Applicant: Hiroshi Fujiwara, Kanagawa (JP)

(72) Inventor: Hiroshi Fujiwara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/720,297

(22) Filed: Apr. 14, 2022

(65) Prior Publication Data

US 2022/0334532 A1 Oct. 20, 2022

(30) Foreign Application Priority Data

Apr. 19, 2021 (JP) ..... 2021-070556

(51) Int. Cl.

| | |
|---|---|
| ***G03G 21/00*** | (2006.01) |
| ***G03G 21/16*** | (2006.01) |
| ***G03G 21/18*** | (2006.01) |
| ***G03G 15/00*** | (2006.01) |
| *G03G 15/08* | (2006.01) |

(52) U.S. Cl.

CPC ..... *G03G 21/1652* (2013.01); *G03G 15/80* (2013.01); *G03G 21/1817* (2013.01); *G03G 21/1867* (2013.01); *G03G 15/0863* (2013.01); *G03G 21/1633* (2013.01); *G03G 2221/166* (2013.01); *G03G 2221/1853* (2013.01)

(58) Field of Classification Search

CPC ..... G03G 15/0863; G03G 15/80; G03G 21/1652; G03G 21/1817; G03G 21/1821; G03G 21/1867; G03G 21/1875; G03G 21/1878; G03G 21/1885; G03G 2215/0695; G03G 2215/0697; G03G 2221/166; G03G 2221/1823; G03G 2221/1853

USPC ..... 399/12, 13, 25, 27, 90, 113, 262

See application file for complete search history.

(56) References Cited

U.S. PATENT DOCUMENTS

| | | | | |
|---|---|---|---|---|
| 6,097,906 | A * | 8/2000 | Matsuzaki | G03G 21/1885 399/90 |
| 2005/0135831 | A1* | 6/2005 | Kawaguchi | G03G 21/1853 399/90 |
| 2005/0226648 | A1* | 10/2005 | Abe | G03G 21/1885 399/90 |

(Continued)

FOREIGN PATENT DOCUMENTS

| | | |
|---|---|---|
| JP | 7-077921 | 3/1995 |
| JP | 2014-232270 | 12/2014 |

*Primary Examiner* — Robert B Beatty

(74) *Attorney, Agent, or Firm* — Xsensus LLP

(57) ABSTRACT

An image forming apparatus includes an apparatus body, a first unit, a second unit, a cover, and a restrictor. The apparatus body includes a body-side connection terminal. The first unit is detachably attached to the apparatus body. The second unit detachably attached to the first unit and includes a unit-side connection terminal. The cover covers the body-side connection terminal disposed in the apparatus body and is movable between a covering position at which the cover covers the body-side connection terminal and a retracted position at which the cover is retracted from the covering position. The restrictor restricts movement of the cover from the covering position to the retracted position in a state in which the first unit is detached from the apparatus body.

8 Claims, 8 Drawing Sheets

(56) References Cited

U.S. PATENT DOCUMENTS

| | | | | |
|---|---|---|---|---|
| 2006/0062589 | A1* | 3/2006 | Sasaki | G03G 21/1885 399/90 |
| 2007/0059018 | A1* | 3/2007 | Tokuda | G03G 21/1652 399/90 |
| 2010/0322664 | A1* | 12/2010 | Matsuda | G03G 21/1842 399/119 |
| 2016/0109827 | A1 | 4/2016 | Yoshida et al. | |
| 2022/0091556 | A1 | 3/2022 | Shimizu et al. | |

* cited by examiner

IMAGE FORMING APPARATUS WITH COVER AND RESTRICTOR TO PROTECT CONNECTION TERMINAL

CROSS-REFERENCE TO RELATED APPLICATION

This patent application is based on and claims priority pursuant to 35 U.S.C. § 119(a) to Japanese Patent Application No. 2021-070556, filed on Apr. 19, 2021, in the Japan Patent Office, the entire disclosure of which is hereby incorporated by reference herein.

BACKGROUND

Technical Field

Embodiments of this disclosure relate to an image forming apparatus.

Related Art

An image forming apparatus is known that includes a first unit attachable to and detachable from a body of the image forming apparatus and a second unit attachable to and detachable from the first unit.

SUMMARY

In an embodiment of the present disclosure, there is provided an image forming apparatus that includes an apparatus body, a first unit, a second unit, a cover, and a restrictor. The apparatus body includes a body-side connection terminal. The first unit is detachably attached to the apparatus body. The second unit detachably attached to the first unit and includes a unit-side connection terminal. The cover covers the body-side connection terminal disposed in the apparatus body and is movable between a covering position at which the cover covers the body-side connection terminal and a retracted position at which the cover is retracted from the covering position. The restrictor restricts movement of the cover from the covering position to the retracted position in a state in which the first unit is detached from the apparatus body.

In another embodiment of the present disclosure, there is provided an image forming apparatus that includes an apparatus body, a unit, a cover, and a restrictor. The apparatus body includes a body-side connection terminal. The unit is detachably attached to the apparatus body and includes a unit-side connection terminal. The cover covers the body-side connection terminal disposed in the apparatus body and is movable between a covering position at which the cover covers the body-side connection terminal and a retracted position at which the cover is retracted from the covering position. The restrictor restricts movement of the cover from the covering position to the retracted position in a state in which the unit is detached from the apparatus body and releases restriction of the movement of the cover while the unit is attached to the apparatus body.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
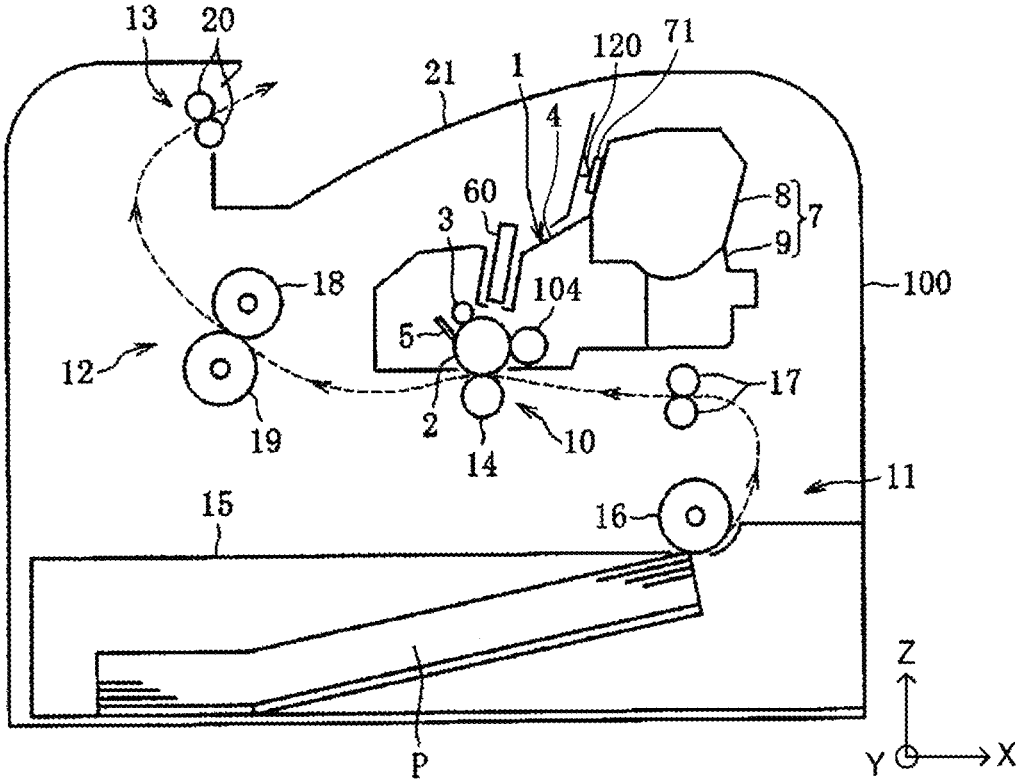
FIG. 1 is a schematic view of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A description is given below of an electrophotographic monochrome image forming apparatus 100 according to an embodiment of the present disclosure. First, a basic configuration of the image forming apparatus 100 is described below. FIG. 1 is a schematic view of the image forming apparatus 100 according to an embodiment of the present disclosure. As illustrated in FIG. 1, the image forming apparatus 100 is a monochrome image forming apparatus. A process cartridge 1 serving as a latent-image-bearer unit is detachably attached to an apparatus body (a body of the image forming apparatus 100).

The process cartridge 1 includes a photoconductor 2 serving as a latent image bearer that bears an image on a surface thereof, a charging roller 3, a developing device 4 serving as a developing module, a cleaning blade 5 serving as a cleaner. The charging roller 3 charges the surface of the photoconductor 2. The developing device 4 includes a developing roller and visualizes the latent image on the photoconductor 2. The cleaning blade 5 cleans the surface of the photoconductor 2. An exposure device 60 that exposes the surface of the photoconductor 2 is disposed at a position facing the photoconductor 2.

A toner cartridge 7 serving as a developer container is detachably attached to the process cartridge 1 (the apparatus body of the image forming apparatus). The toner cartridge 7 includes a developer housing portion 8 serving as a toner housing that accommodates toner serving as developer to be supplied to the developing device 4, and a developer collecting portion 9 serving as a waste toner housing that collects toner (waste toner) removed by the cleaning blade 5. In the image forming apparatus 100 of the present embodiment, the developer housing portion 8 and the developer collecting portion 9 are integrated.

The image forming apparatus 100 further includes a transfer device 10 that transfers an image onto a sheet serving as a recording medium, a sheet feeder 11 that supplies the sheet, a fixing device 12 that fixes the image transferred onto the sheet, and a sheet ejection device 13 that ejects the sheet to the outside of the apparatus. The transfer device 10 includes a transfer roller 14 as a transferor. The transfer roller 14 contacts the photoconductor 2 in a state in which the process cartridge 1 is attached to the apparatus body, thereby forming a transfer nip between the transfer roller 14 and the photoconductor 2. The transfer roller 14 is connected to a power supply that applies at least one of a predetermined direct current (DC) voltage and a predetermined alternating current (AC) voltage to the transfer roller 14.

The sheet feeder 11 includes a sheet tray 15 and a feed roller 16. The sheet tray 15 stores sheets P. The feed roller 16 feeds the sheets P stored in the sheet tray 15. A registration roller pair 17 is disposed downstream from the feed roller 16 in a sheet conveying direction. The registration roller pair 17 functions as a timing roller pair to convey a sheet P to a secondary transfer nip at a proper timing of conveyance of the sheet P. Note that the sheets P may be thick paper, postcards, envelopes, plain paper, thin paper, coated paper, art paper, tracing paper, or the like. Additionally, overhead projector (OHP) transparency (OHP sheet or OHP film) may be used as a recording medium.

The fixing device 12 includes a fixing roller 18 serving as a fixing rotator and a pressure roller 19 serving as a pressure rotator. The fixing roller 18 is heated by a heating source such as a heater. The pressure roller 19 is pressed against and contacts the fixing roller 18 to form a fixing nip in an area of contact between the fixing roller 18 and the pressure roller 19. The sheet ejection device 13 includes an output roller pair 20. The sheet P ejected by the output roller pair 20 is stacked on an output tray 21 formed such that an upper face of the apparatus body is partly recessed.

Next, image forming operations of the image forming apparatus 100 according to the present embodiment are described below. As an image formation starts, the photoconductor 2 are driven to rotate. The charging roller 3 uniformly charges an outer circumferential surface of the photoconductor 2 at a predetermined polarity. The exposure device 60 exposes the charged surface of the photoconductor 2 based on image data from a reading device or a computer to form an electrostatic latent image. The electrostatic latent image formed on the photoconductor 2 is developed into a toner image (a visible image) with toner supplied by the developing roller 104 of the developing device 4.

As the image formation starts, the feed roller 16 starts rotating to feed the sheet P from the sheet tray 15 toward the registration roller pair 17. The registration roller pair 17 temporarily stops the sheet P fed by the feed roller 16. Then, the rotation of the registration roller pair 17 is started at a predetermined timing, and the sheet P is conveyed to the transfer nip in accordance with the timing at which the toner image on the photoconductor 2 reaches the transfer nip. At this time, a transfer voltage having a polarity opposite a polarity of the charged toner contained in the toner image on the photoconductor 2 is applied to the transfer roller 14, thereby generating a transfer electric field in a transfer area. The toner image on the photoconductor 2 is transferred onto the sheet P by the transfer electric field. After the transfer process, the cleaning blade 5 removes residual toner, which failed to be transferred onto the sheet P, remaining on the photoconductor 2. Thus, the removed toner is conveyed to and collected in the developer collecting portion 9 in the toner cartridge 7.

After the toner image is transferred onto the sheet P, the sheet P bearing the toner image is conveyed to the fixing device 12. The fixing device 12 fixes the toner image onto the sheet P under heat and pressure while the sheet P is conveyed through the fixing nip between the fixing roller 18 and the pressure roller 19. The sheet P is ejected to the outside of the apparatus by the output roller pair 20 and is stacked on the output tray 21.

The toner cartridge 7 includes an identification (ID) chip 71 as a unit-side connection terminal. The ID chip 71 stores identification data such as a serial number and data on, for example, a use history such as the remaining amount of toner. The ID chip 71 is a contact-type data storage device, and when the ID chip 71 is attached to the apparatus body, the connection terminal of the 1D chip 71 contacts the connector 120 as a body-side connection terminal disposed in the apparatus body. As a result, the toner cartridge 7 can communicate with the image forming apparatus 100.

The image forming apparatus 100 reads identification data from the ID chip 71 when the toner cartridge 7 is attached, and confirms whether the attached toner cartridge is a toner cartridge compatible with the image forming apparatus 100. Ina case where the toner cartridge is not compatible with the image forming apparatus 100, a warning is displayed on a control panel of the image forming apparatus 100, a warning lamp is turned on, or a sound such as a buzzer is generated to notify a user that the toner cartridge compatible with the image forming apparatus 100 is not attached.

The image forming apparatus 100 receives data of the remaining amount of toner from the ID chip 71 when the toner cartridge 7 is attached and grasps the toner amount of the toner cartridge 7. The image forming apparatus 100 calculates the remaining amount of toner in the toner cartridge 7 based on the grasped toner amount of the toner cartridge 7 and the used toner amount, for example, at the end of printing or after the toner supply operation. Then, the calculated remaining amount of toner is written in the ID chip 71.

Figure 2:
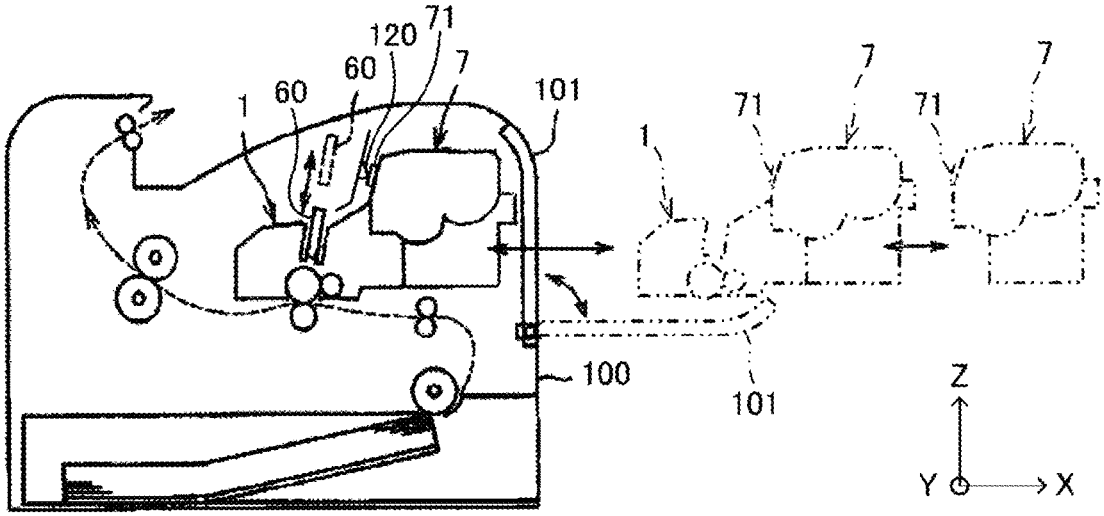
FIG. 2 is a diagram illustrating a way of attachment and detachment of a process cartridge of the image forming apparatus illustrated in FIG. 1.

FIG. 2 is a diagram illustrating a way of attachment and detachment of the process cartridge 1 of the image forming apparatus 100. As illustrated in FIG. 2, an opening and closing cover 101 provided on the front of the apparatus body of the image forming apparatus 100 can be opened and closed. When the opening and closing cover 101 is opened and the exposure device 60 is retracted to a retracted position indicated by a broken line in FIG. 1 by a link mechanism, the process cartridge 1 can be removed from the front of the apparatus body while avoiding interference with the exposure device 60.

In the present embodiment, the toner cartridge 7 and the process cartridge 1 can be attached to and detached from the apparatus body of the image forming apparatus 100 as a single unit from the front of the apparatus body in a state in which the process cartridge 1 as a first unit is attached to the toner cartridge 7 as a second unit. The toner cartridge 7 can be attached to and detached from the process cartridge 1 both in a state in which the process cartridge 1 is attached to the apparatus body and in a state in which the process cartridge 1 is detached from the apparatus body.

The toner cartridge 7 is locked to the process cartridge 1 by a lock mechanism. When the lock mechanism is released, the toner cartridge 7 can be attached to and detached from the process cartridge 1. Note that, for example, a lock mechanism of a related art may be use as the lock mechanism.

Figure 3:
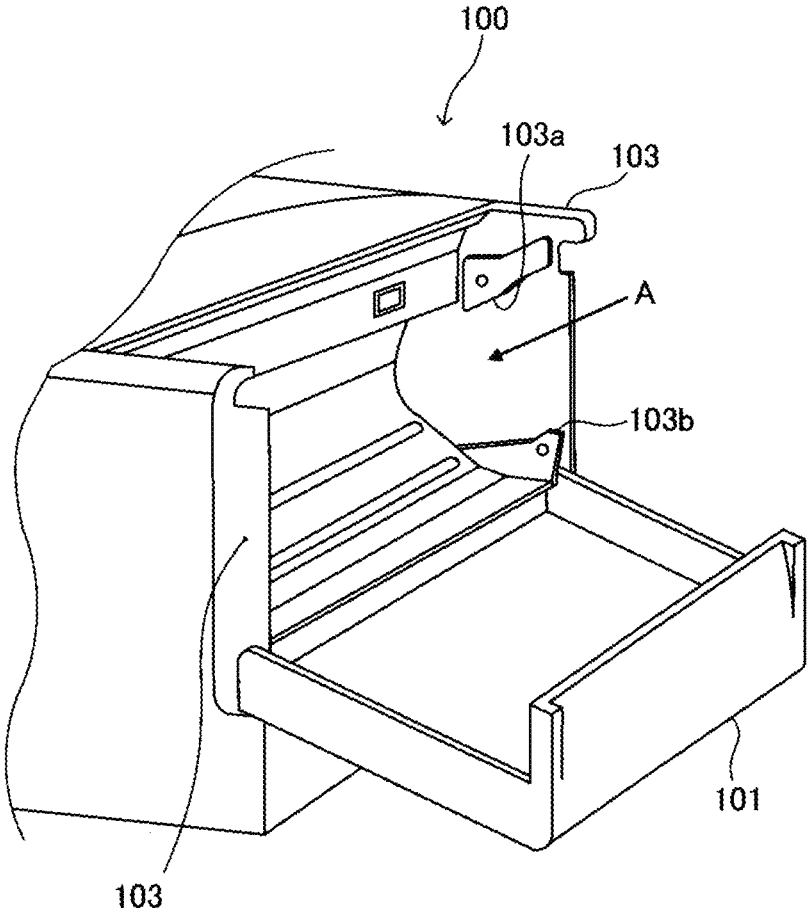
FIG. 3 is a perspective view of the image forming apparatus from which the process cartridge illustrated in FIG. 2 has been removed.

FIG. 3 is a perspective view of the image forming apparatus 100 from which the process cartridge 1 is removed. The inner surface of each of the side walls 103 of the image forming apparatus 100 has an upper guide 103*a* and a lower guide 103*b* to guide the process cartridge 1 to the apparatus body. The upper guide 103*a* and the lower guide 103*b* are inclined to descend from the upstream side (i.e., the front of the apparatus body and in the direction of the opening and closing cover) to the downstream side in the attaching direction of the process cartridge 1.

A lower end of a face plate 31 (see FIG. 7) of the process cartridge 1 is guided by the lower guide 103*b*, and the process cartridge 1 is attached to and detached from the apparatus body while being guided by the upper guide 103*a* from an upper end of the face plate 31. When the process cartridge 1 is attached to the apparatus body, the process cartridge 1 attached to the apparatus body while being guided obliquely downward by the guides 103*a* and 103*b* as indicated by an arrow A in FIG. 3.

Figure 4:
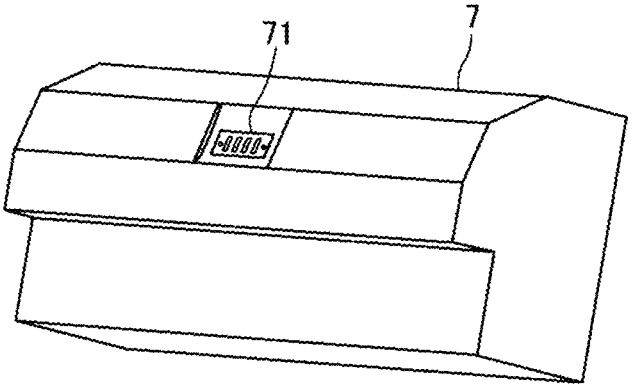
FIG. 4 is a perspective view of a toner cartridge.
Figure 5:
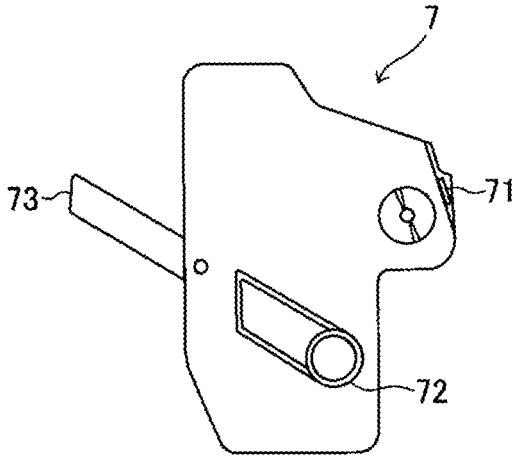
FIG. 5 is a side view of the toner cartridge.

FIG. 4 is a schematic perspective view of the toner cartridge 7. FIG. 5 is a side view of the toner cartridge 7. As illustrated in FIG. 4, the ID chip 71 as the unit-side connection terminal is attached to a side wall of the toner cartridge 7 on the downstream side in the attaching direction of the toner cartridge 7 to the apparatus body of the image forming apparatus 100. As illustrated in FIG. 5, on the upstream side in the attaching direction, the toner cartridge 7 includes a handle 73 that a user grips when the toner cartridge 7 is attached to or detached from the process cartridge 1. The side wall of the toner cartridge 7 has a guide 72 protruding from the side wall.

Figure 6:
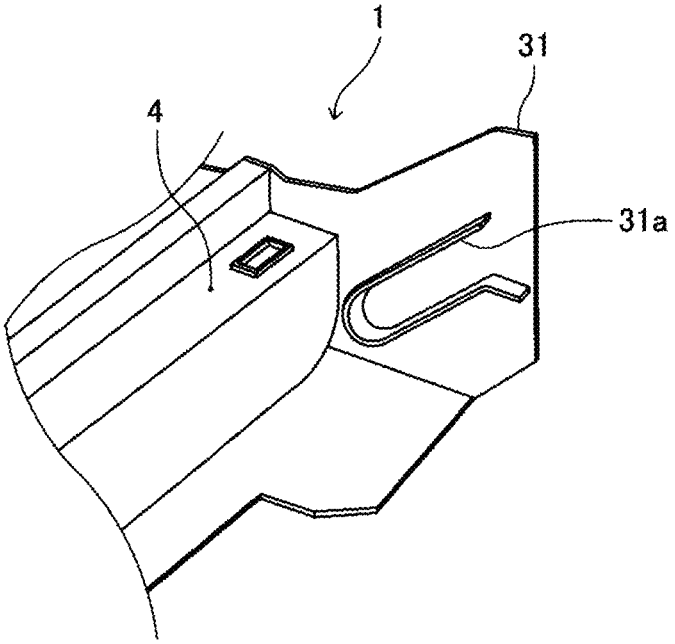
FIG. 6 is a perspective view of the process cartridge from which the toner cartridge has been removed.

FIG. 6 is a perspective view of the process cartridge 1 from which the toner cartridge 7 has been removed. As illustrated in FIG. 6, the face plate 31 of the process cartridge 1 has a guide groove 31*a* to guide the toner cartridge 7. The guide groove 31*a* is inclined to descend toward a downstream end of the guide groove 31*a* in the attaching direction of the toner cartridge 7.

Figure 7:
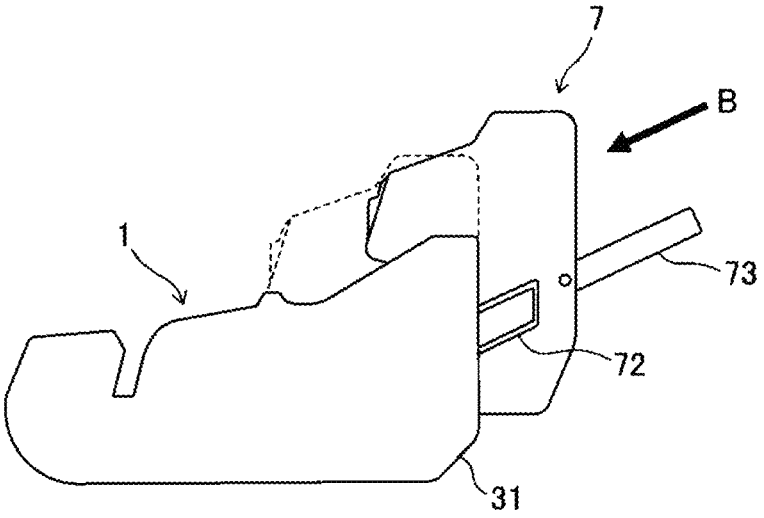
FIG. 7 is a schematic diagram illustrating a state in which the toner cartridge is attached to the process cartridge.

FIG. 7 is a diagram illustrating a state in which the toner cartridge 7 is attached to the process cartridge 1. When the toner cartridge 7 is attached to the process cartridge 1, the guide 72 illustrated in FIG. 5 is inserted into the guide groove 31*a* illustrated in FIG. 6. As a result, the toner cartridge 7 is attached to the process cartridge 1 while being guided by the guide groove 31*a*. As described above, the guide groove 31*a* is inclined downward. Accordingly, the toner cartridge 7 guided by the guide groove 31*a* is moved obliquely downward and attached as indicated by an arrow B in FIG. 1 in the same manner as well as when the process cartridge 1 is attached to the apparatus body.

Figure 8:
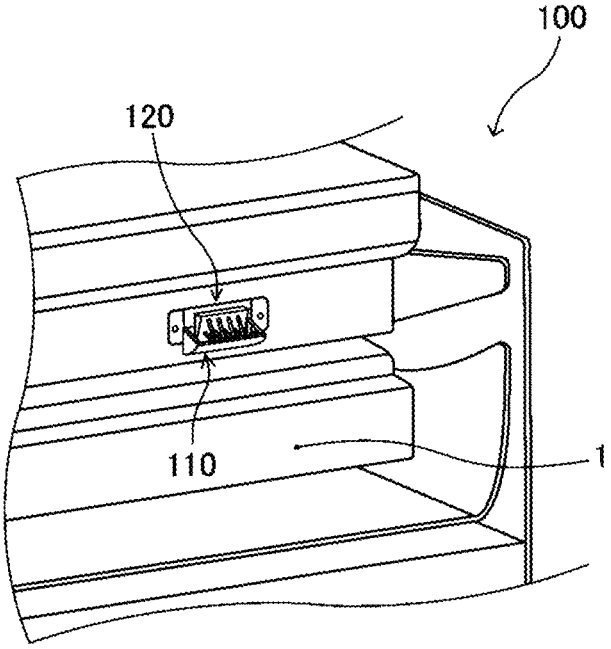
FIG. 8 is a perspective view of the image forming apparatus from which the toner cartridge has been removed.

FIG. 8 is a perspective view of the image forming apparatus 100 from which the toner cartridge 7 has been removed. As illustrated in FIG. 8, when the toner cartridge 7 is removed, the connector 120 of the apparatus body to communicate with the ID chip 71 is exposed. When the connector 120 is exposed, for example, a user might touch the terminal of the connector 120 or a component may hit the terminal of the connector 120. Thus, the terminal of the connector 120 might be damaged. For this reason, when the toner cartridge 7 is removed, a cover 110 covers the connector 120 to protect the terminal of the connector 120.

Figure 9A:
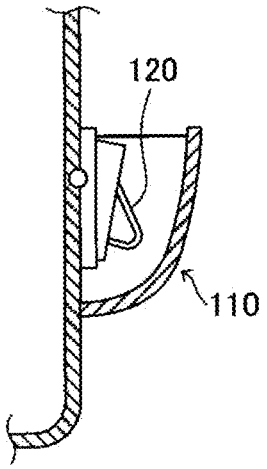
FIG. 9A is a schematic view of a cover at a covering position at which the cover covers a connector.
Figure 9B:
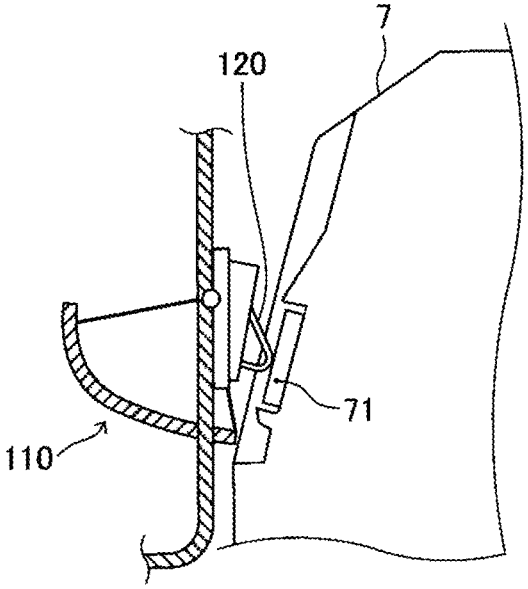
FIG. 9B is a schematic view of the cover at a retracted position at which the cover is retracted from the covering position.

FIG. 9A is a schematic view of the cover 110 at a covering position at which the cover 110 covers the connector 120. FIG. 9B is a schematic view of the cover 110 at a retracted position at which the cover 110 is retracted from the covering position. The cover 110 is rotatably supported and is movable between the covering position illustrated in FIG. 9A and the retracted position illustrated in FIG. 9B by rotation. The cover 110 is biased by a torsion spring so as to be positioned at the covering position. When the cover 110 is at the covering position, the cover 110 abuts against a stopper disposed in the apparatus body so as not to rotate beyond the covering position due to a biasing force of the torsion spring.

Figure 10:
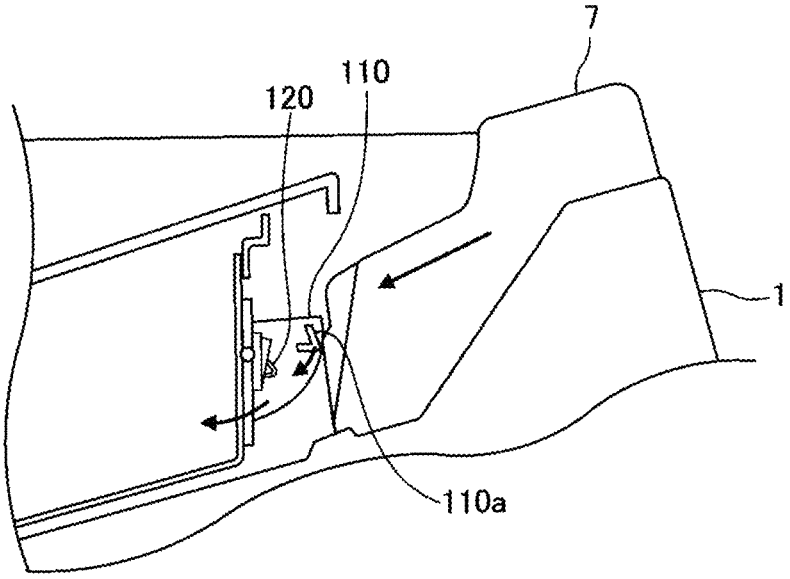
FIG. 10 is a diagram illustrating a state in which the process cartridge to which the toner cartridge has been attached is attached to an apparatus body.

FIG. 10 is a diagram illustrating a state in which the process cartridge 1 to which the toner cartridge 7 has been attached is attached to the apparatus body. As illustrated in FIG. 10, the cover 110 has a contact portion 110*a* against which the toner cartridge 7 abuts. When the process cartridge 1 to which the toner cartridge 7 has been attached is attached to the apparatus body, the process cartridge is moved obliquely downward by the guides 103*a* and 103*b*. Accordingly, the toner cartridge 7 attached to the process cartridge 1 moves obliquely downward and contacts the contact portion 110*a* of the cover 110 from obliquely above.

Even when the toner cartridge 7 abuts against the contact portion 110*a*, the process cartridge 1 is moved obliquely downward because the process cartridge 1 is not attached to the apparatus body. Then, the contact portion 110*a* is pushed obliquely downward by the toner cartridge 7, and the cover 110 rotates clockwise in FIG. 10 against the biasing force of the torsion spring. As a result, the cover 110 located at the covering position is moved to the retracted position by the toner cartridge 7.

When the process cartridge 1 is attached to the apparatus body, the cover 110 is located at the retracted position illustrated in FIG. 9B. Thus, the connector 120 is coupled to the ID chip 71, and the process cartridge 1 can communicate with the ID chip 71.

When the toner cartridge 7 is attached to the process cartridge 1 having been attached to the apparatus body, the toner cartridge 7 is moved obliquely downward while the toner cartridge 7 is guided by the guide groove 31*a* of the process cartridge 1. Accordingly, the toner cartridge 7 abuts against the contact portion 110*a* of the cover 110 from obliquely above in the same manner as described above. Thus, in the same manner as described above, the contact portion 110*a* is pushed obliquely downward by the toner cartridge 7, and the cover 110 rotates clockwise in FIG. 10 against the biasing force of the torsion spring. As a result, the cover 110 located at the covering position is moved to the retracted position by the toner cartridge 7.

After the process cartridge 1 to which the toner cartridge 7 has been attached is detached from the apparatus body, for example, the user may erroneously attach the toner cartridge 7 alone to the apparatus body to which the process cartridge 1 is not attached. When the toner cartridge 7 is inserted into the apparatus body, the cover 110 may move from the covering position to the retracted position, and the connector 120 may be exposed.

Even if the user tries to attach the toner cartridge 7 alone to the apparatus body in a state in which the process cartridge 1 is detached from the apparatus body, the attachment is not completed because the process cartridge 1 is not installed. Since the toner cartridge 7 is attached to the apparatus body without being guided by the guide groove 31*a*, the toner cartridge 7 is movable in the apparatus body in a direction other than the guiding direction by the guide groove 31*a*. Accordingly, the user moves the toner cartridge 7 in the direction other than the guiding direction by the guide groove 31*a* in the apparatus body and searches for the attaching position of the toner cartridge 7. At this time, the toner cartridge 7 might abut against the exposed connector 120 from the direction other than the guide direction of the guide groove 31*a*, and the connector 120 might be damaged.

For this reason, in the present embodiment, when the process cartridge 1 is detached from the apparatus body, the movement of the cover 110 from the covering position to the retracted position is restricted. Accordingly, when the toner cartridge 7 is inserted into the apparatus body in a state in which the process cartridge 1 is detached from the apparatus body, the cover 110 can be prevented from moving to the retracted position. As a result, the connector 120 is not exposed. Such a configuration can prevent the toner cartridge 7 from contacting the connector 120, thus preventing the connector 120 from being damaged. Next, a description is given of details of the present embodiment, with reference to the drawings.

Figure 11A:
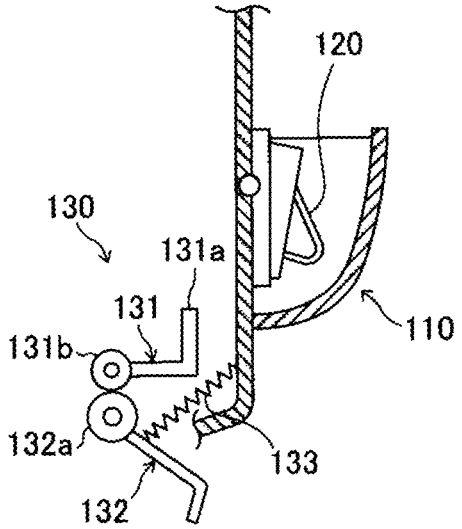
FIG. 11A is a schematic view of a movement restricting mechanism.
Figure 11B:
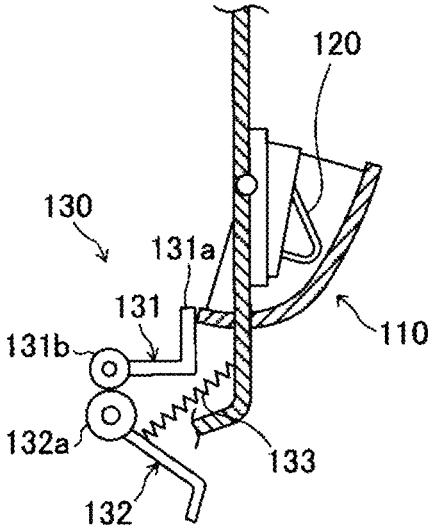
FIG. 11B is a diagram illustrating a configuration of the movement restricting mechanism in a state in which the movement restricting mechanism restricts movement of the cover from the covering position to the retracted position.

FIG. 11A is a schematic view of a configuration of a movement restricting mechanism 130. FIG. 11B is a schematic view of the movement restricting mechanism 130 in a state in which the process cartridge 1 is removed from the apparatus body and the movement restricting mechanism 130 restricts movement of the cover 110 from the covering position to the retracted position. The movement restricting mechanism 130 includes a restrictor 131 and an interlocking member 132. The restrictor 131 is rotatable between a restricting position (see FIG. 11B) for restricting the movement of the cover 110 from the covering position to the retracted position and a release position (see FIG. 13B) for releasing the restriction of the movement of the cover 110.

The restrictor 131 has a restricting portion 131*a* that is positioned on a trajectory of rotation of the cover 110 when the restrictor 131 is at the restricting position. If the cover 110 is moved from the covering position to the retracted position when the restrictor 131 is at the restricting position as illustrated in FIG. 11B, the cover 110 abuts against the restricting portion 131*a*, so that the movement of the cover 110 to the retracted position is restricted.

As described above, when the process cartridge 1 is detached from the apparatus body, the movement of the cover 110 to the retracted position is restricted. Accordingly, when the toner cartridge 7 alone is inserted into the apparatus body in a state in which the process cartridge 1 is detached from the apparatus body, the cover 110 does not move to the retracted position. As a result, damage of the connector 120 can be prevented.

The movement restricting mechanism 130 includes the interlocking member 132. The interlocking member 132 moves the restrictor 131 between the restricting position and the release position in accordance with attachment and detachment of the process cartridge 1 with respect to the apparatus body. The interlocking member 132 is rotatably supported and has an interlocking gear 132*a* that meshes with a drive gear 131*b* of the restrictor 131. The interlocking member 132 is biased counterclockwise in FIG. 13A by a tension spring 133.

Figure 12A:
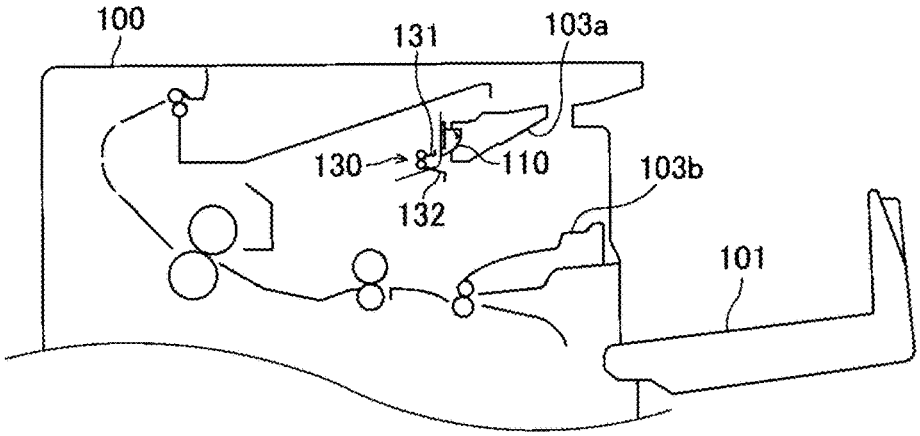
FIG. 12A is a diagram illustrating a state in which a process cartridge to which a toner cartridge has been attached is attached to an apparatus body.
Figure 12B:
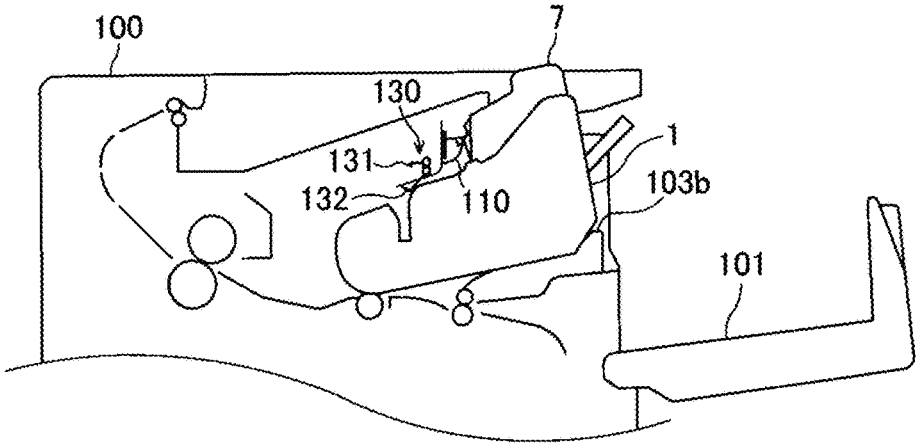
FIG. 12B is a diagram illustrating a state in which the process cartridge to which the toner cartridge has been attached is attached to the apparatus body, subsequent to the state in FIG. 12A.
Figure 12C:
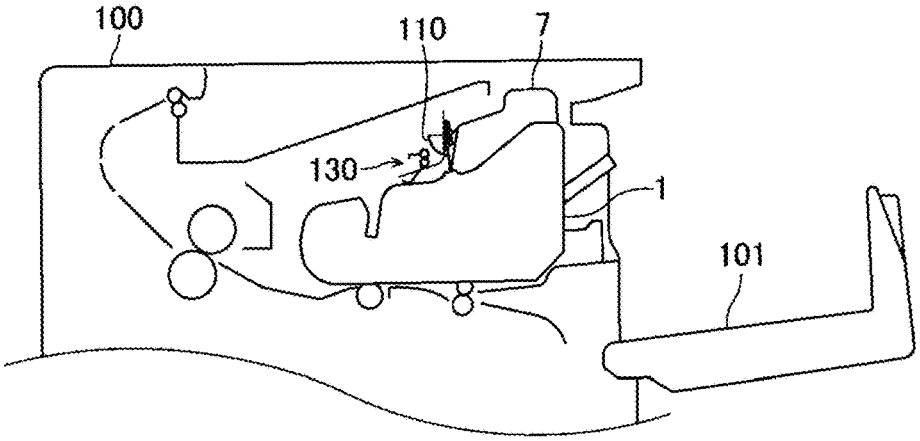
FIG. 12C is a diagram illustrating a state in which the process cartridge to which the toner cartridge has been attached is attached to the apparatus body, subsequent to the state in FIG. 12B.
Figure 13A:
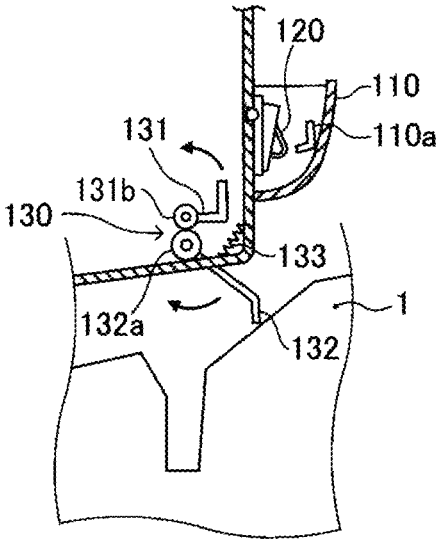
FIG. 13A is a diagram illustrating an operation of a movement restricting mechanism.
Figure 13B:
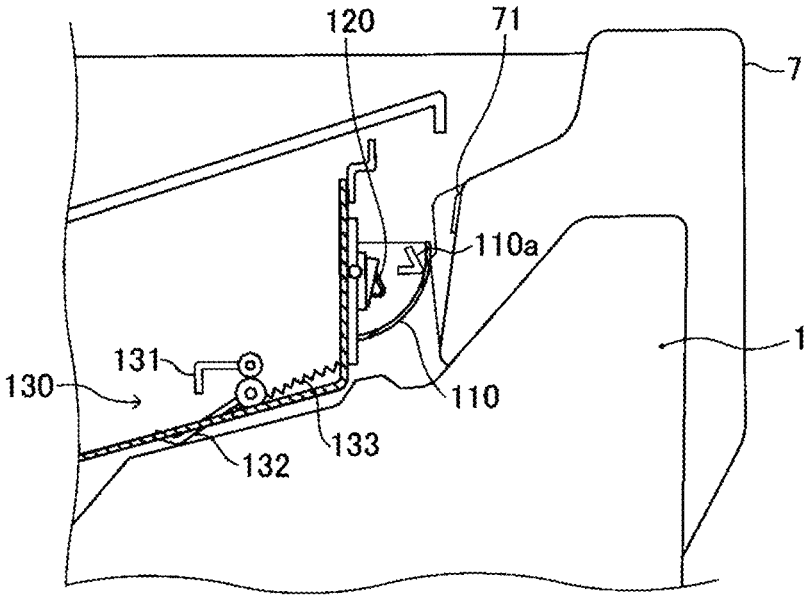
FIG. 13B is a diagram illustrating an operation of the movement restricting mechanism when the toner cartridge is attached, subsequent to the state in FIG. 13A.
Figure 13C:
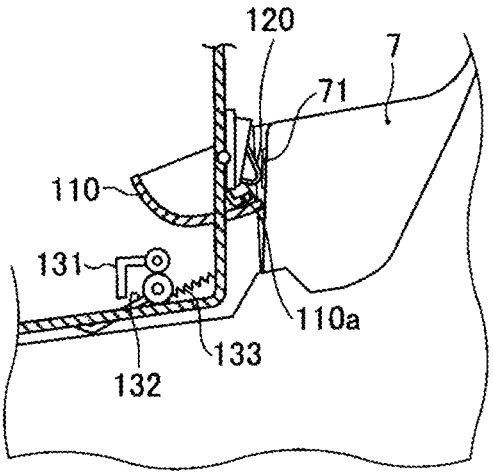
FIG. 13C is a diagram illustrating an operation of the movement restricting mechanism when the toner cartridge is attached, subsequent to the state in FIG. 13B.

FIGS. 12A to 12C are diagrams illustrating states in which the process cartridge 1 to which the toner cartridge 7 has been attached is attached to the apparatus body. FIGS. 13A to 13C are diagrams illustrating states of the movement restricting mechanism 130 corresponding to FIGS. 12A to 12C. When the process cartridge 1 to which the toner cartridge 7 has been attached is inserted into the apparatus body from the state illustrated in FIG. 12A, the process cartridge 1 abuts against the interlocking member 132 as illustrated in FIG. 13A. When the process cartridge 1 is further inserted into the apparatus body in the state illustrated in FIG. 13A, the interlocking member 132 rotates clockwise in FIG. 13A against the biasing force of the tension spring 133. As the interlocking member 132 rotates, the interlocking gear 132*a* of the interlocking member 132 rotates. Thus, the restrictor 131 positioned at the restricting position rotates counterclockwise in FIG. 13A together with the drive gear 131*b* meshed with the interlocking gear 132*a*.

As illustrated in FIGS. 12B and 13B, before the toner cartridge 7 abuts against the contact portion 110*a* of the cover 110, the restrictor 131 moves to the release position. Thereafter, in the same manner as described above, the contact portion 110*a* is pushed obliquely downward by the toner cartridge 7, and the cover 110 rotates clockwise in FIG. 13B against the biasing force of the torsion spring. As illustrated in FIGS. 12C and 13C, the cover 110 located at the covering position is moved to the retracted position by the toner cartridge 7. As a result, the connector 120 is exposed and coupled to the ID chip 71.

When the process cartridge 1 to which the toner cartridge 7 has been attached is detached, the cover 110 moves from the retracted position to the covering position by the biasing force of the torsion spring. Then, the interlocking member 132 rotates counterclockwise in FIG. 13C due to the biasing force of the tension spring 133, and the restrictor 131 moves from the release position to the restricting position.

When only the toner cartridge 7 is attached or detached in a state in which the process cartridge 1 is attached to the apparatus body, the restrictor 131 is located at the release position. Accordingly, when only the toner cartridge 7 is detached from the apparatus body, the cover 110 moves from the retracted position to the covering position by the biasing force of the torsion spring and covers the connector 120.

When the toner cartridge 7 is detached in a state in which the process cartridge 1 is attached to the apparatus body, the movement of the cover 110 from the covering position to the retracted position is not restricted by the restrictor 131. However, when the toner cartridge 7 is attached in a state in which the process cartridge 1 is attached to the apparatus body, the toner cartridge 7 is attached to the process cartridge 1 in the apparatus body while being guided by the guide groove 31*a* of the process cartridge 1. Accordingly, since the toner cartridge 7 cannot move in a direction other than the guide direction of the guide groove 31*a*, the toner cartridge 7 abuts against the connector 120 only in the guide direction of the guide groove 31*a*. As a result, the toner cartridge 7 does not abut against the connector 120 from an unexpected direction, and the connector 120 is not damaged.

In the above description, although the cover 110 moves to the retracted position after the regulating member 131 moves to the release position, the movement of the cover 110 to the retracted position may be started at any desired timing after the movement of the restrictor 131 to the release position is started. With the configuration as well, the cover 110 can be moved to the retracted position without abutting against the restrictor 131.

Note that the restrictor 131 may be moved between the release position and the retracted position using a drive motor. For example, a sensor may be disposed to detect attachment or detachment of the process cartridge 1. The drive motor may be controlled based on the detection result of the sensor to move the restrictor 131 between the release position and the retracted position.

In the above description, the process cartridge 1 is described as an example of the first unit, and the toner cartridge 7 is described as an example of the second unit. The configuration is not limited to this. For example, the present disclosure can be applied to a combination of a photoconductor unit including a photoconductor as the first unit and a developing device as the second unit detachably attached to the photoconductor unit. The present disclosure can be also applied to a combination of a developing device as the first unit and a toner cartridge as the second unit detachably attached to the developing device.

Further, a combination of the cover 110 and the movement restricting mechanism 130 may be applied to attachment and detachment of a single unit with respect to the apparatus body. The cover 110 covers the body-side connection terminal such as the connector disposed on the apparatus body. The movement restricting mechanism 130 restricts the movement of the cover 110 from the covering position to the retracted position. When the single unit is detached, the cover 110 is moved to the covering position, and the movement of the cover 110 from the covering position to the retracted position is restricted by the restrictor 131. As a result, the user moves the cover 110 from the covering position to the retracted position to prevent the user from touching the connector of the apparatus body.

When the single unit is attached to the apparatus body, a portion of the single unit that abuts against the interlocking member 132 abuts against the apparatus body to move the restrictor 131 to the release position earlier than a portion of the single unit that abuts against the cover 110 to rotate the cover 110 to the retracted position. After the restrictor 131 is moved to the release position, the portion of the single unit that abuts against the cover 110 abuts against the cover 110 and moves the cover 110 from the covering position to the retracted position.

The above-described embodiments are given as examples, and, for example, the following aspects of the present disclosure may have advantageous effects described below.

First Aspect

An image forming apparatus includes an apparatus body, a first unit, a second unit, and a cover such as the cover 110. The first unit such as the process cartridge 1 is detachably attached to the apparatus body. The second unit such as the toner cartridge 7 is detachably attached to the first unit. The cover such as the cover 110 covers a body-side connection terminal such as the connector 120 disposed in the apparatus body. The body-side connection terminal is coupled to a unit-side connection terminal such as the ID chip 71 disposed in the second unit. The cover such as the cover 110 is movable between a covering position at which the cover covers the body-side connection terminal and a retracted position at which the cover is retracted from the covering position. A movement of the cover such as the cover 110 from the covering position to the retracted position is restricted when the first unit is detached from the apparatus body. As an image forming apparatus including a first unit such as a process cartridge detachably attached to an apparatus body and a second unit such as a toner cartridge detachably attached to the first unit, for example, an image forming apparatus according to a comparative example has the following configuration. That is, a unit-side connection terminal such as an ID chip is disposed in the second unit, and when the second unit is attached to the apparatus body, the second unit is coupled to a body-side connection terminal such as a connector terminal disposed in the apparatus body to transmit and receive data such as ID data. When the second unit is detached from the apparatus body alone or together with the first unit, the cover covers the body-side terminal such that the body-side connection terminal is not exposed. The cover is movable between a covering position where the cover covers the body-side connection terminal and a retracted position where the cover retracts from the covering position. When the second unit is attached to the first unit having been attached to the apparatus body, the cover is positioned at the retracted position. Thus, the unit-side connection terminal and the body-side connection terminal are coupled with each other. However, in the comparative example, after the first unit to which the second unit has been attached is detached from the apparatus body, the user may erroneously attach the second unit alone to the apparatus body by mistake because the user believes that the first unit is attached to the apparatus body. In this case, the cover may move from the covering position to the retracted position, and the body-side connection terminal may be exposed, in conjunction with the insertion of the second unit into the apparatus body. Even if the user attaches the second unit alone to the apparatus body in a state in which the first unit is detached from the apparatus body, attachment of the second unit is not completed because the first unit to which the second unit has been attached is not attached to the apparatus body. The user who believes that the first unit is attached to the apparatus body searches for an attaching position of the second unit on the first unit and moves the second unit in the apparatus body until the user notices that the first unit is not attached on the apparatus body. At this time, the second unit might abut against the body-side connection terminal from an unexpected direction, and the body-side connection terminal might be damaged. For this reason, in the first aspect, the movement of the cover to the retracted position is restricted when the first unit is detached from the apparatus body. As a result, even if the second unit is inserted into the apparatus body to attach the second unit alone to the apparatus body by mistake in a state in which the first unit is detached from the apparatus body, the cover does not move to the retracted position in conjunction with the insertion operation of the second unit. Accordingly, in a state in which the cover covers the body-side connection terminal and the first unit is detached from the apparatus body, the second unit does not abut against the body-side connection terminal when the user may erroneously attach the second unit alone to the apparatus body by mistake. Thus, damage to the body-side connection terminal may be restricted.

Second Aspect

The image forming apparatus according to the first aspect includes a restrictor such as the restrictor 131. The restrictor such as the restrictor 131 restricts the movement of the cover such as the cover 110 from the covering position to the retracted position when the first unit such as the process cartridge 1 is detached from the apparatus body. According to this configuration, as described in the embodiment, the movement of the cover such as the cover 110 from the covering position to the retracted position may be restricted by the restrictor such as the restrictor 131.

Third Aspect

In the image forming apparatus according to the second aspect, the restrictor such as the restrictor 131 is movable between a restricting position at which the restrictor restricts the movement of the cover such as the cover 110 from the covering position to the retracted position and a release position at which the restrictor releases the restriction of the movement of the cover such as the cover 110. The restrictor such as the restrictor 131 moves between the restricting position and the release position in conjunction with the attachment and detachment of the first unit such as the process cartridge 1 with respect to the apparatus body. According to this configuration, as described in the above-described embodiment, when the first unit such as the process cartridge 1 is detached from the apparatus body, the restrictor such as the restrictor 131 may be positioned at the restricting position. When the first unit is attached to the apparatus body, the restrictor such as the restrictor 131 may be positioned at the release position.

Fourth Aspect

In the image forming apparatus according to the third aspect, when the first unit such as the process cartridge 1 to which the second unit such as the toner cartridge 7 has been attached is attached to the apparatus body, the cover such as the cover 110 starts moving from the covering position to the retracted position after the restrictor such as the restrictor 131 starts moving from the restricting position to the release position. According to this configuration, as described in the embodiment, the cover such as the cover 110 may be moved to the retracted position without abutting against the restrictor such as the restrictor 131.

Fifth Aspect

In the fourth aspect, the cover such as the cover 110 moves between the covering position and the retracted position in conjunction with attachment and detachment of the second unit such as the toner cartridge 7 with respect to the first unit such as the process cartridge 1 having been attached to the apparatus body, and in conjunction with attachment and detachment of the first unit to which the second unit has been attached with respect to the apparatus body. According to this configuration, when the second unit such as the toner cartridge 7 is detached from the apparatus body, the cover such as the cover 110 may be positioned at the covering position, and the body-side connection terminal such as the connector 120 may be protected. On the other hand, when the second unit such as the toner cartridge 7 is attached to the apparatus body, the cover such as the cover 110 can be positioned at the retracted position, and the body-side connection terminal can be coupled to the unit-side connection terminal such as the ID chip 71.

Sixth Aspect

An image forming apparatus includes a cover and a unit detachably attached to an apparatus body. The cover is movable between a covering position where the cover covers a body-side connection terminal disposed in the apparatus body that connects to a unit-side connection terminal of the unit and a retracted position where the cover is retracted from the covering position. When the unit is detached from the apparatus body, a movement of the cover from the covering position to the retracted position is restricted. Thus, the restriction on the movement of the cover is released while the unit is attached to the apparatus body. As described in the embodiment, in a state in which the unit is detached from the apparatus body, such a configuration can prevent the user from touching the cover and moving the cover from the covering position to the retracted position. As a result, the body-side connection terminal may be favorably protected with the cover. On the other hand, since the restriction on the movement of the cover is released while the unit is attached to the apparatus body, the cover can be located at the retracted position. Thus, the body-side connection terminal can be coupled to the unit-side connection terminal.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image forming apparatus comprising:

an apparatus body including a body-side connection terminal;

a first structure detachably attached to the apparatus body;

a second structure detachably attached to the first structure, the second structure including a unit-side connection terminal;

a cover to cover the body-side connection terminal disposed in the apparatus body, the cover movable between a covering position at which the cover covers the body-side connection terminal and a retracted position at which the cover is retracted from the covering position by the second structure in conjunction with attachment and detachment of the second structure with respect to the first structure; and a restrictor to restrict movement of the cover from the covering position to the retracted position in a state in which the first structure is detached from the apparatus body.

2. The image forming apparatus according to claim 1, wherein the restrictor is movable between a restricting position at which the restrictor restricts the movement of the cover from the covering position to the retracted position and a release position at which the restrictor releases restriction of the movement of the cover, and wherein the restrictor moves between the restricting position and the release position by the first structure in conjunction with attachment and detachment of the first structure with respect to the apparatus body.

3. The image forming apparatus according to claim 2, wherein when the first structure to which the second structure has been attached is attached to the apparatus body, the cover is configured to start moving from the covering position to the retracted position after the restrictor starts moving from the restricting position to the release position.

4. The image forming apparatus according to claim 3, wherein the cover is configured to move between the covering position and the retracted position in conjunction with attachment and detachment of the second structure with respect to the first structure, which has been attached to the apparatus body.

5. The image forming apparatus according to claim 3, wherein the cover is configured to move between the covering position and the retracted position in conjunction with attachment and detachment of the first structure to which the second structure has been attached with respect to the apparatus body.

6. The image forming apparatus according to claim 1, wherein the first structure includes a guide groove, which is inclined to descend toward a downstream end of the guide groove in an attaching direction of the second structure, the second structure includes a guide protruding from a side wall of the first structure toward a direction perpendicular to the attaching direction of the second structure, and the guide is inserted into the guide groove when the second structure is moved obliquely downward and attached to the first structure.

7. The image forming apparatus according to claim 6, wherein the second structure further comprises a handle on an upstream side in the attaching direction that a user grips when the second structure is attached to or detached from the first structure.

8. An image forming apparatus comprising:

an apparatus body including a body-side connection terminal;

a structure detachably attached to the apparatus body, the structure including a unit-side connection terminal;

a cover to cover the body-side connection terminal disposed in the apparatus body, the cover movable between a covering position at which the cover covers the body-side connection terminal and a retracted position at which the cover is retracted from the covering position; and a restrictor to:

restrict movement of the cover from the covering position to the retracted position in a state in which the structure is detached from the apparatus body; and release restriction of the movement of the cover while the structure is attached to the apparatus body, wherein the structure includes a first structure and a second structure detachably attached to the first structure, the cover is movable between the covering position and the retracted position by the second structure in conjunction with attachment and detachment of the second structure with respect to the first structure, and the restrictor is movable between a restricting position at which the restrictor restricts the movement of the cover from the covering position to the retracted position and a release position at which the restrictor releases restriction of the movement of the cover by the first structure in conjunction with attachment and detachment of the first structure with respect to the apparatus body.

* * * * *